United States Patent [19]

Bierwiler

[11] 4,137,665

[45] * Feb. 6, 1979

[54] CHILDREN'S MARIONETTE THEATRE

[76] Inventor: Martha Bierwiler, 120 E. Hazel St., Orlando, Fla. 32804

[ * ] Notice: The portion of the term of this patent subsequent to May 28, 1991, has been disclaimed.

[21] Appl. No.: 686,486

[22] Filed: May 14, 1976

Related U.S. Application Data

[63] Continuation of Ser. No. 469,795, May 14, 1974, abandoned.

[51] Int. Cl.[2] ..... A63H 33/00

[52] U.S. Cl. ..... 46/13; 46/216; 35/45; 272/31 R

[58] Field of Search ..... 35/43, 45; 46/13, 216; 272/22, 23, 24, 31 R; 273/105.2

[56] References Cited

U.S. PATENT DOCUMENTS

| | | | |
|---|---|---|---|
| 1,093,024 | 4/1914 | App | 35/45 |
| 1,247,888 | 11/1917 | Smith et al. | 272/22 |
| 1,429,382 | 9/1922 | Vaughan | 46/216 |
| 1,611,155 | 12/1926 | Bisaillon | 46/13 X |
| 2,009,337 | 7/1935 | Brewer | 46/13 X |
| 2,226,032 | 11/1940 | Wahlberg | 35/45 |
| 2,283,104 | 5/1942 | Surman | 46/13 |
| 2,418,718 | 4/1947 | Maginley | 35/45 |
| 2,551,317 | 5/1951 | Damiano | 46/216 |
| 2,620,591 | 12/1952 | Scola | 46/13 |
| 2,793,860 | 5/1957 | De Crescenzo | 46/202 X |
| 3,242,595 | 3/1966 | Eastman | 35/45 |
| 3,396,487 | 8/1968 | Risser | 46/40 X |
| 3,451,161 | 6/1969 | Lemelson | 46/216 X |
| 3,476,385 | 11/1969 | Foy | 272/24 |

FOREIGN PATENT DOCUMENTS

| | | | |
|---|---|---|---|
| 930015 | 7/1955 | Fed. Rep. of Germany | 46/216 |

*Primary Examiner*—F. Barry Shay
*Attorney, Agent, or Firm*—Charles W. Helzer

[57] ABSTRACT

An improved children's marionette theatre for self-propelled puppet-like objects utilizing a housing formed from collapsible sides, back and ceiling members that may be readily collapsed into a relatively flat compact structure for ease of transport and storage. The housing defines a stage on which puppet-like objects are displayed and includes an upper ceiling member disposed over the stage. The upper ceiling member has path-like guide means formed by a track suspended from the under surface of the ceiling member and on which self-propelled puppet transport vehicles are supported. Means are provided for securing puppet-like objects to the self-propelled vehicles for display and movement across the stage. The puppet-like objects may comprise facsimiles of the sun, earth, moon and other planets as well as the inclusion of lighting effects to simulate stars, galaxies and constellations.

17 Claims, 5 Drawing Figures

FIG. 3
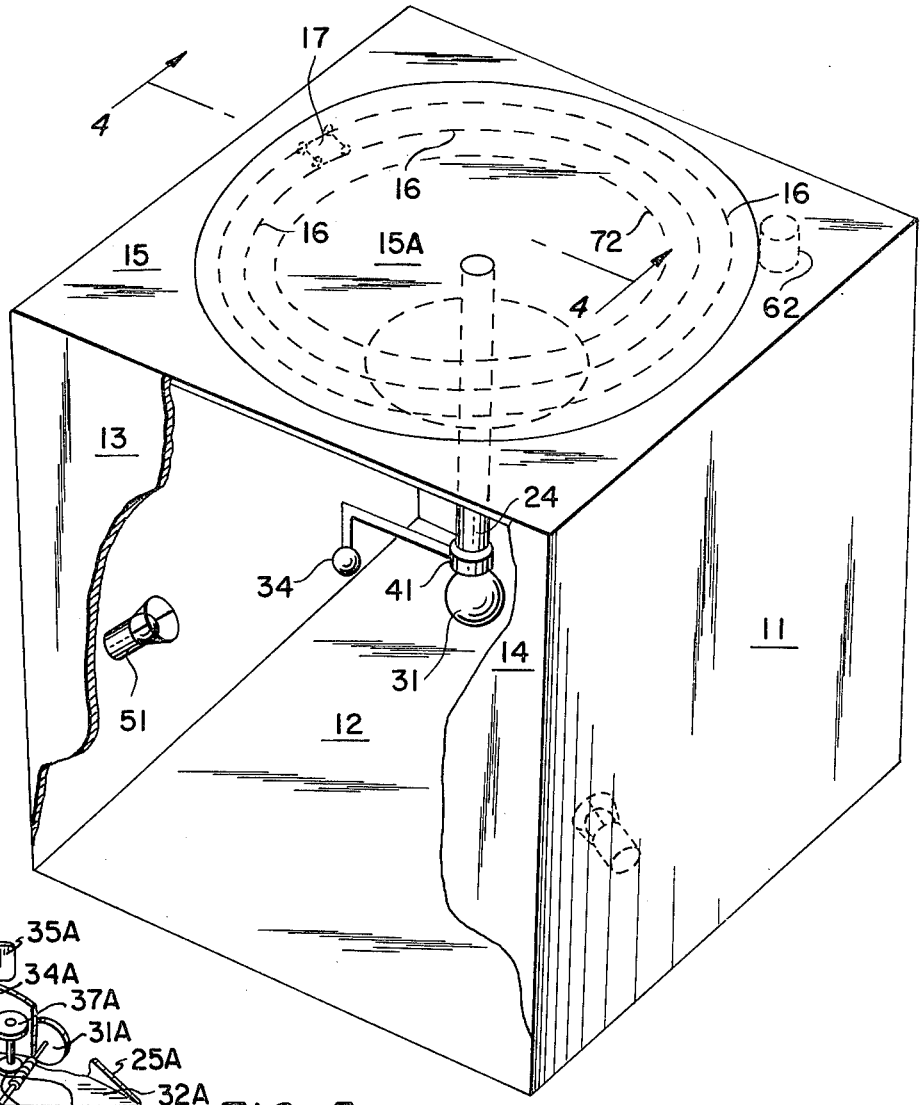
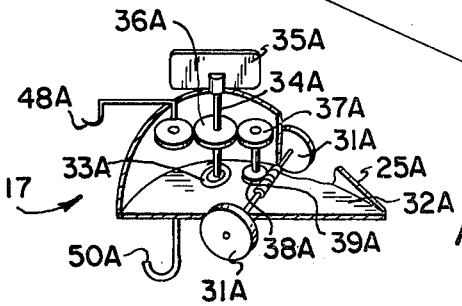
FIG. 5
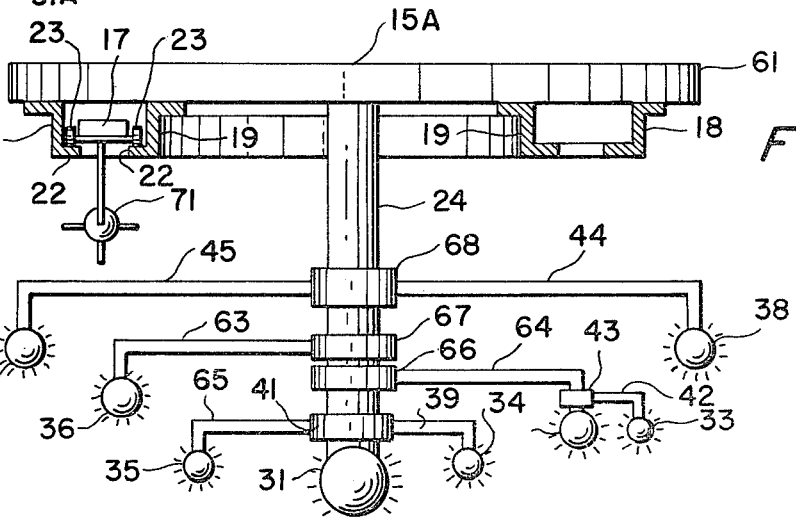
FIG. 4

CHILDREN'S MARIONETTE THEATRE

This is a continuation of application Ser. No. 469,795, filed May 14, 1974, now abandoned.

BACKGROUND OF INVENTION

1. Field of Invention

This invention relates to a new and improved animated children's marionette theatre.

More particularly, the invention relates to an improvement in an animated children's marionette theatre of the type described and claimed in co-pending U.S. Pat. No. 3,812,611, issued May 28, 1974 by the same inventor and entitled "Animated Children's Marionette Theatre."

2. Prior Art Problem

The above-referenced co-pending U.S. Pat. No. 3,812,611 describes and claims an animated children's marionette theatre employing animated puppet-like figures which is readily and economically fabricated, can be folded up flat for easy transport and storage, and can be set up and operated by children easily.

While the animated children's marionette theatre described in co-pending U.S. Pat. No. 3,812,611 is suitable for many uses and purposes, and can be employed in many different play formats, the present invention is designed to make available additional uses and play formats for which it is better suited.

SUMMARY OF INVENTION

It is, therefore, a primary object of the present invention to provide a new and improved, animated children's marionette theatre utilizing an improved construction for supporting a self-propelled puppet transport vehicle.

Another object of the invention is to provide an improved, animated children's marionette theatre having the above-set-forth characteristics which is also better suited for use in plays and playacting which center about the outer universe.

Still another object of the invention is to provide a new and improved children's marionette theatre which utilizes a rotatable lazy susan-type support member for imparting movement to puppet-like objects displayed on the stage of the theatre.

In practicing the invention, an animated children's marionette theatre is provided using self-propelled puppet-like objects and comprises a housing formed from collapsible sides, back and ceiling members which may be collapsed into a relatively flat compact structure for ease of transport and storage. The housing, when assembled, defines a stage on which puppet-like objects are displayed and includes an upper ceiling member which is disposed over the stage area. The upper ceiling member has path-like guide means formed on it on which at least one general purpose self-propelled puppet transport vehicle is supported. Means are provided for readily securing puppet-like objects to the vehicle for display and movement as the vehicle moves along the guide means.

The path-like guide means comprises a track secured by screws or otherwise to the under surface of the ceiling member with the track being of predetermined configuration to provide a predesigned pattern of movement for the puppet-like objects secured on the self-propelled puppet transports as they are moved across the track. The track secured to the underside of the upper ceiling member preferably is open-ended and extends from one open-ended point at the edge of the ceiling member over a predetermined path and terminates at a second different open-ended point on the edge of the ceiling member whereby the self-propelled puppet transport vehicles may be loaded and unloaded on the track along an open accessible edge of the ceiling member. In a preferred embodiment, a rotatable member of the lazy susan-type is secured to a self-propelled puppet transport vehicle, and puppet-like objects are secured or suspended from the rotatable platorm for movement therewith. The puppet-like objects may be shaped and arranged to represent the sun, earth, moon and other planets of the universe. Where so used, it is desirable that additional lighting effect means be provided for producing images of stars, constellations, galaxies of the universe on the stage setting provided by the housing.

These and other objects, features and many of the attendant advantages of this invention will be appreciated more readily as the same becomes better understood by reference to the following detailed description when considered in connection with the accompanying drawings, wherein like parts in each of the several figures are identified by the same reference character; and wherein:

BRIEF DESCRIPTION OF THE DRAWINGS

FIG. 3 is a top perspective view of a second embodiment of a new and improved animated children's marionette theatre according to the invention;

FIG. 4 is a partial sectional view taken through plane 4—4 of FIG. 3; and FIG. 5 is a schematic illustration of a suitable general purpose, self propelled, puppet transport vehicle usable with the invention.

DETAILED DESCRIPTION OF PREFERRED EMBODIMENTS

Figure 1:
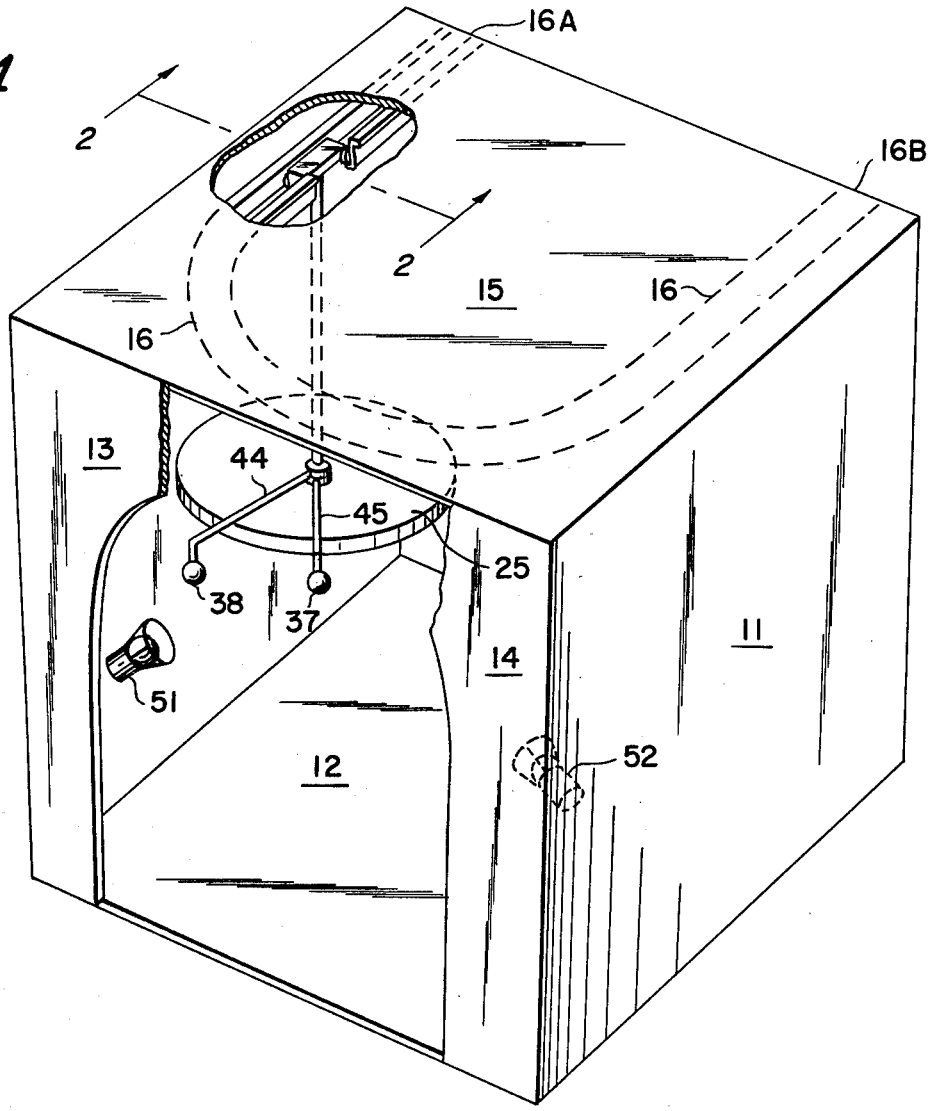
FIG. 1 is a partially broken away perspective view of a preferred form of a new and improved, animated children's marionette theatre according to the invention.

FIG. 1 is a front perspective view of a housing (11) having a front central opening through which a viewer observes the stage area (12) of the children's animated marionette theatre formed in part by the housing (11). For a more detailed description of suitable material and methods for forming the housing (11), reference is made to co-pending U.S. Pat. No. 3,812,611, the disclosure of which is hereby incorporated by reference in its entirety. Briefly, however, it can be said that the housing (11) may be formed from any suitable, inexpensive material such as paper board, cardboard, plastic or the like and generally has side, top, and at least partial back walls which may be hinged together to form a collapsible box. The front of the housing may be closed by suitable curtain material shown generally at (13) and (14), that is drawn open at the commencement of a play in the usual manner. The curtain material preferably does not draw away from the top portion of the front of the housing (11) in order that the top portion of the curtain material hides the mechanical details of the theatre from a viewer as will be described hereinafter. However, for convenience, in FIG. 1 the top portion of the curtain has been shown broken away to enable the viewer to see, at least in part, some of the mechanisms to be described hereinafter.

Figure 2:
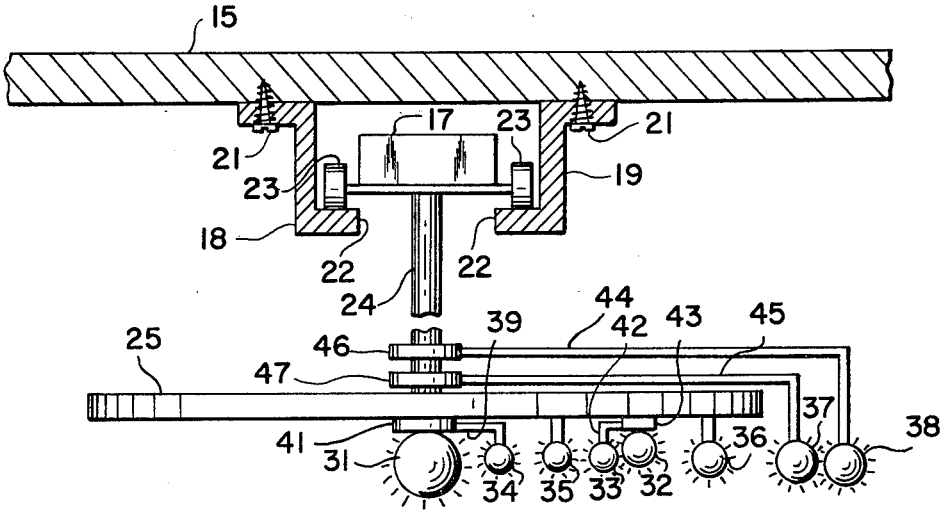
FIG. 2 is a partial sectional view of the embodiment of the invention shown in FIG. 1 taken through plane 2—2.

The animated children's marionette theatre shown in FIG. 1 differs from the theatre disclosed in co-pending U.S. Pat. No. 3,812,611 primarily in the design and construction of the upper ceiling member (15). As best seen in FIG. 2 of the drawings, the upper ceiling member (15) of the current invention comprises an essentially solid, flat member supported on the side walls of housing (11). As shown in dotted outline form at (16) in FIG. 1, the upper ceiling member (15) has secured to its under surface a guide means (16) that is formed by a track in which at least one self-propelled puppet transport vehicle (17) is supported. The track (16) may be comprised by two opposing essentially Z-shaped track members (18) and (19) that are secured to the under surface of the upper ceiling member (15) by screws (21). The track members (18) and (19) include inwardly projecting edges or lips that are spaced apart and define a central opening throughout the extent of the guide track (16) formed by the track members (18) and (19). As disclosed in the above-referenced co-pending U.S. Pat. No. 3,812,611, the self-propelled puppet transport vehicle (17) may comprise a mechanical spring wound toy tractor, an electric battery driven toy tractor, or other similar self-propelled vehicle having wheels (23) that ride along the upper surfaces of the inwardly extending lips (22) of track members (18) and (19).

The self-propelled puppet transport vehicle (17) has a lower rotatable shaft (24) projecting from its under surface and includes a spring wound, electric drive or other suitable motor mechanism (not shown) for rotating the shaft (24) at some predetermined rotational speed. This mechanism for rotating shaft (24) is in addition to the drive mechanism for causing the wheels (23) to move the transport vehicle (17) along the guide path formed by the track members (18) and (19). Secured to the lower end of the rotatable shaft (24) is a flat, circular rotatable member (25) of the lazy susan-type. The member (25) is secured to shaft (24) so that it rotates in synchronization with shaft (24). As a result of this arrangement, the lazy susan member (25) will be slowly rotated as the puppet transport vehicle (17) is caused to move along the extent of the guide path (16) defined by the track members (18) and (19). To facilitate loading and unloading the entire arrangement of the transport vehicle (17) and attached rotatable lazy susan member (25) onto the track members (18) and (19), it is desirable that the elongated track (16) defined by the track members (18) and (19) extend from one open-ended point (16A) at the edge of the ceiling member (15) (preferably the back edge) over a predetermined path and terminate at a second open-ended point (16B) on an edge of the ceiling member. As a result of such construction, the self-propelled puppet transport vehicles readily may be loaded and unloaded on the track along the open accessible back edge of the ceiling member.

In the embodiment of the invention shown in FIGS. 1 and 2, the particular puppet-like objects which are depicted are intended to represent the sun shown at (31), the earth shown at (32) and moon (33) together with other planets of the universe including Mercury (34), Venus (35), Mars (36), Jupiter (37) and Saturn (38). The Sun (31) is represented by a rather large lightbulb located at the center of rotation of the lazy susan member (25). The planet Mercury is located closest to the sun is mounted on a short rotating arm (39) which in turn is driven by a self-rotating mechanism (41) of conventional construction for causing the arm (39) and lightbulb (34) representing the planet Mercury to be rotated around the shaft (24) at a rate of rotation faster than that of shaft (24). Similarly, the lightbulb representing the earth (32) has a small rotating arm (42) and self-rotating mechanism (43) attached thereto for causing the smaller lightbulb (33) representative of the moon to be rotated about the earth. The two outermost planets, Saturn (38) and Jupiter (37), likewise are mounted on respective elongated rotating lever arms (44) and (45) which, in turn, are rotated relative to the shaft (24) and rotating lazy susan member (25) by self-rotating mechanisms (46) and (47), respectively. Other puppet-like objects could be used in place of the sun, earth and other planets depicted, should it be desired. For example, it would be entirely possible to suspend an array of horses from the lazy susan member (25) in the manner of the merry-go-round. Further, in place of the rotating shaft (24) and lazy susan member (25) it would be entirely possible to suspend individual puppet-like characters from a general purpose puppet transport vehicle (17) in a manner similar to that described in the above-referenced co-pending U.S. Pat. No. 3,812,611.

FIG. 5 is a schematic illustration of a suitable, mechanically wound spring type of general purpose, self-propelled puppet transport vehicle usable with the invention. The general purpose puppet transport vehicle shown in FIG. 5 corresponds identically to that illustrated and described in FIGS. 4 and 4A of U.S. Pat. No. 3,812,611 with the exception that the letter A has been appended to each of the reference numerals employed in connection with FIG. 5. For a more detailed description of the general purpose puppet transport vehicle shown in FIG. 5 reference is made to the appropriate portions of co-pending U.S. Pat. No. 3,812,611.

For the purpose of the present disclosure, it is believed sufficient to point out that the general purpose puppet transport vehicle 17 shown in FIG. 5 includes a pair of hooks 48A and 50A on which puppet-like objects readily can be attached to the puppet transport vehicle by a child playing with the marionette theatre. Other forms of readily manipulated attaching means could be employed in place of the hooks 48A and 50A as would be obvious to one skilled in the art. The general purpose puppet transport vehicle 17 shown in FIG. 5 comprises a mechanical, spring wound toy tractor having wheels 31A supported from a body member 32A that contains a coil spring 33A capable of being wound around a shaft 34A by a key 35A. Shaft 34A has a drive gear 36A keyed to it which meshes with and drives a speed increasing gear 37A that in turn drives a pinion 38A and worm gear 39A secured to the axle that drives wheels 31A. Other drive configurations are possible and for that matter a small battery operated, electric motor drive could be employed for driving the general purpose, self-propelled puppet transport vehicles 25. The term "general purpose" is derived from the fact that the puppet transport vehicle shown in FIG. 5 can be employed to move any desired puppet-like character or object across the stage of the marionette theatre in accordance with the wishes of a child operating the marionette theatre. In this manner, considerable diversity in the nature of the puppet plays which can be presented with the theatre can be achieved. Because of the ease in changing puppet-like objects to be suspended from the general purpose transport vehicle, presentation of a puppet play by a child is facilitated.

In addition to the above described members and objects, it would be desirable for completeness and authenticity to include a background screen in the area to the rear of the marionette theatre housing (11) upon which pictures of stars, constellations, galaxies and perhaps clouds can be displayed from a suitable light projector such as those indicated at (51) and (52). With such a background, it will be appreciated that a considerable educational effect can be made on young minds with a playhouse constructed in accordance with the present invention by using the rotating lazy susan member (25) with the sun (31) as its center and the various planets of the universe rotating about it, coupled with an appropriate description of the makeup of the universe. By changing the backdrop and lighting effects to show the earth, and utilizing only the sun (31), demonstrations can be made of how the sun comes out and rises to the East and sets in the West with an appropriate description tied to the movement of the puppet transport vehicle as it causes the sun (31) to rise by moving out and across the front of the stage and then set as it moves toward (16B) in its path of movement from (16A) to (16B). Other plots and arrangements will be suggested to those skilled in the art in the light of these teachings.

FIG. 3 is a partially broken away perspective view of a second embodiment of an animated children's marionette theatre according to the present invention. In the embodiment of the invention shown in FIG. 3, the upper ceiling member (15) itself is provided with a central opening and a circular, rotatable ceiling portion (15A) is provided which acts as a lazy susan member. The peripheral edge of rotatable ceiling portion (15A) may be provided with an overriding lip portion which is supported by and rides on suitable ball bearing, roller bearing, or other anti-friction members (not shown). A notched gear tooth rack is formed around the peripheral edge of rotatable ceiling portion (15A) as indicated at (61) in FIG. 4 and coacts with a pinion gear drive indicated generally in dotted outline form at (62) in FIG. 1, for causing the rotatable ceiling portion (15A) to be slowly rotated.

Suspended from the hub of the central rotatable ceiling portion (15A) is a fixed shaft (24) which supports a plurality of rotating arms (44), (45), (63), (64), (65), and (39), for supporting the various planets represented by the lightbulbs (32) and (34–38), and the enlarged lightbulb (31), secured to the end of shaft (24) representing the sun. A plurality of rotatable self-driven mechanisms (41), (66–68) of conventional known construction coact with the central shaft (24) to cause the rotating arms (44), (45), (63–65), and (39), to be rotated relative to the central shaft (24). The speeds of rotation of each of the drive mechanisms may be different to allow for relative rotation between the sun and the various planets. Here again, the planet earth represented by the lightbulb (32) is provided with an additional lever arm (42) and self-rotating mechanism (43) for causing the smaller bulb (33) representative of the moon to be rotated about the earth. With this arrangement, the universal arrangement of the planets, the sun and the moon are not caused to be moved over the ceiling portion of the marionette theatre but remain relatively fixed in the center of the stage, although rotated relative to each other.

On the under surface of the central rotating ceiling member portion (15A), a guide means (16) is provided which is formed by essentially Z-shaped track members (18) and (19) mounted by set screws or other suitable means to the under surface of (15A) to form a circular track, as indicated by (16) in FIG. 1, around the periphery of the rotatable ceiling member. A puppet transport vehicle (17) is mounted in and supported by the track members (18) and (19) on the under surface of rotatable seiling member (15A). Puppet transport vehicle (17) has suspended from it a puppet-like object which may be in the form of a space ship as shown at (71). With this arrangement, the lazy susan ceiling member (15A) is caused to rotate together with the self-rotating drive mechanisms (41) and (66–68) for causing relative rotation of the various planets, the earth and the moon with respect to the sun. Concurrently with this action, the space ship (71) is caused to move through space over the guide means (16) provided by the track members (18) and (19). If desired, suitable switching accommodations can be provided at the back of the ceiling member (15) that connect with the track (16) in the rotatable ceiling member portion (15A) in a manner similar to track switches of a railroad track, to facilitate loading and unloading of the puppet transport vehicles onto track members (18) and (19). Further, parallel track arrangements may be included as indicated by the second dotted line set of track (72) shown in FIG. 3 of the drawings. Also, suitable light projectors such as shown at (51) may be provided along with a backdrop for projecting light images of stars, galaxies, constellations, clouds or other images needed to provide a realistic effect for the viewer of the marionette theatre.

From the foregoing description, it will be appreciated that the present invention provides a new and improved animated children's marionette theatre. The new and improved animated children's theatre includes an improved construction for the suspended track on which a puppet transport vehicle moves together with an improved lazy susan-type of suspension for the various puppet-like objects being displayed on the stage of the theatre.

Having described several embodiments of a new and improved animated children's marionette theatre according to the invention, it is believed obvious that other modifications and variations of the invention will be suggested to those skilled in the art in the light of the above teachings. It is, therefore, to be understood that changes may be made in the particular embodiments of the invention described which are within the full intended scope of the invention as defined by the appended claims.

What is claimed is:

1. A children's marionette theatre for self-propelled puppet-like objects comprising a housing defining a stage on which a multiplicity of different, interchangeable movable puppet-like objects are displayed in the manner of a puppet show, an upper ceiling member disposed over the stage having path-like guide means formed thereon, and and at least one general purpose self-propelled puppet transport vehicle supported on said ceiling member and guided by said guide means, said transport vehicle having hook means for easy use by children in securing selected ones of different, interchangeable puppet-like objects to said transport vehicle for display and movement across the stage whereby loading, movement and display of the puppet-like objects across the stage in the performance of a puppet show by children operating the marionette theatre, is facilitated.

2. A children's marionette theatre according to claim 1 wherein the housing is formed from collapsible sides, back and ceiling members which may be collapsed into a relatively flat compact structure for ease of transport and storage.

3. A children's marionette theatre according to claim 1 wherein the puppet-like objects are two-dimensional figures formed from paper board, plastic and the like.

4. A children's marionette theatre according to claim 1 wherein the puppet-like objects are three-dimensional figures formed from plastic and the like.

5. A children's marionette theatre according to claim 1 wherein the guide means formed on the ceiling member is of predetermined configuration defining desired patterns of movement for the puppet-like objects displayed on the stage.

6. A children's marionette theatre according to claim 1 wherein the guide means is comprised by a track of predetermined configuration secured to the underside of the ceiling member and accommodates one or more self-propelled puppet transport vehicles whereby the puppet-like objects are displayed and moved across the stage in accordance with predetermined movement patterns.

7. A children's marionette theatre according to claim 6 wherein the track secured to the underside of the upper ceiling member is open ended and forms an elongated track extending from one open ended point at an edge of the ceiling member over a predetermined path and terminates at a second different open ended point on an edge of the ceiling member whereby self-propelled puppet transport vehicles readily may be loaded and unloaded on the track along an open accessible edge of the ceiling member.

8. A children's marionette theatre according to claim 1 wherein the upper ceiling member itself is rotatably supported.

9. A children's marionette theatre according to claim 8 wherein the guide means is comprised by a track of predetermined configuration secured to the underside of the rotatable ceiling member and accommodates one or more self-propelled puppet transport vehicles whereby the puppet-like objects are displayed and moved across the stage in accordance with predetermined movement patterns relative to the rotational movement of the ceiling member.

10. A children's marionette theatre according to claim 1 further including means for imparting relative movement to the puppet-like objects in addition to the movement thereof by the self-propelled puppet transport vehicle.

11. A children's marionette theatre according to claim 1 wherein the housing is formed from collapsible sides, back and ceiling members which may be collapsed into a relatively flat compact structure for ease of transport and storage, and wherein the guide meams in the upper ceiling member is formed by an open ended and elongated track suspended from the under surface of the ceiling member and extending from one point at an edge of the ceiling member over a predetermined path and terminating at a second open ended point on an edge of the ceiling member whereby self-propelled puppet transport vehicles readily may be loaded and unloaded on the track.

12. A children's marionette theatre according to claim 11 further including means for imparting relative movement to the puppet-like objects in addition to the movement thereof by the self-propelled puppet transport vehicle.

13. A children's marionette theatre according to claim 1 wherein a rotatable platform of the lazy susan-type is rotatably suspended from the self-propelled puppet transport vehicle and puppet-like objects are suspended from the rotatable platform for movement therewith.

14. A children's marionette theatre according to claim 13 further including means for imparting relative movement to at least certain of the puppet-like objects in addition to and different from the movement imparted thereto by the rotation of the rotatable platform.

15. A children's marionette theatre according to claim 14 wherein the puppet-like objects are shaped and arranged to represent the sun, earth, moon and other planets of the universe.

16. A children's marionette theatre according to claim 15 wherein means for lighting the puppet-like objects are provided and further including lighting effect means for producing images of stars, constellations and galaxies on the stage setting.

17. A children's marionette theatre according to claim 1 further including lighting effect means for producing desired supporting light images on the stage in conjunction with the moving puppet-like objects.

* * * * *